United States Patent [19]

Kolb et al.

[11] Patent Number: 4,861,244

[45] Date of Patent: Aug. 29, 1989

[54] SPIRAL DISPLACEMENT MACHINE WITH CONCAVE CIRCULAR ARCS SEALINGLY ENGAGING CIRCULAR STEPS

[75] Inventors: Roland Kolb, Dielsdorf; Jürg Weber, Birmenstorf, both of Switzerland

[73] Assignee: BBC Brown Boveri AG, Baden, Switzerland

[21] Appl. No.: 168,226

[22] Filed: Mar. 15, 1988

[30] Foreign Application Priority Data

Mar. 24, 1987 [CH] Switzerland ..... 1108/87

[51] Int. Cl.[4] ..... F04C 18/04; F04C 27/00

[52] U.S. Cl. ..... 418/15; 418/55; 418/60

[58] Field of Search ..... 418/15, 55, 59, 60

[56] References Cited

U.S. PATENT DOCUMENTS 4,477,238 10/1984 Terauchi ..... 418/55

FOREIGN PATENT DOCUMENTS 0077214 4/1983 European Pat. Off. .
2603462 8/1976 Fed. Rep. of Germany .
3107231 9/1982 Fed. Rep. of Germany .
3141525 5/1983 Fed. Rep. of Germany .
3231756 3/1984 Fed. Rep. of Germany .
3313000 10/1984 Fed. Rep. of Germany .
3407939 7/1985 Fed. Rep. of Germany .
8511707 4/1986 Fed. Rep. of Germany .
1502080 10/1967 France .

*Primary Examiner*—John J. Vrablik
*Attorney, Agent, or Firm*—Oblon, Spivak, McClelland, Maier & Neustadt

[57] ABSTRACT

In a displacement machine for compressible media on the spiral principle, the rotor disk (2) terminates radially flush with the displacement strips (3, 3'). So that the disk (2) can pass through the housing, in the inlet region (12, 12') of the machine the inner web (18, 18') of one housing half (7) is lowered by the amount of the disk thickness. To prevent leaks during the operation of the machine, the transition (19, 19') between the raised web (17, 17') and the lowered web (18, 18') is made circular. The rounding cooperates with a clearance (20, 20') in the form of an arc of a circle in the disk (2). Machines of this type are especially suitable for the supercharging of internal-combustion engines.

1 Claim, 3 Drawing Sheets

SPIRAL DISPLACEMENT MACHINE WITH CONCAVE CIRCULAR ARCS SEALINGLY ENGAGING CIRCULAR STEPS

BACKGROUND OF THE INVENTION

1. Field of the Invention

The invention relates to a displacement machine for compressible media, with at least four feed spaces arranged in a stationary housing, where, in the case of four feed spaces, each housing half has two feed spaces offset approximately 180° relative to one another and extending spirally from an inlet to an outlet, and there is assigned to each feed space a displacement body engaging in this and held vertically, as a spiral strip, on a disk-shaped rotor which can be driven eccentrically relative to the housing and for the guidance of which in the housing there is a second guide eccentric arrangement arranged at a distance from the first drive eccentric arrangement.

2. Discussion of Background

Displacement machines of the type mentioned are known, for example, from No. DE-C3-2,603,462. These machines are characterized by a virtually pulsation-free conveyance of the gaseous working medium consisting, for example, of air or an air/fuel mixture and can therefore also be used advantageously for the purposes of the super-charging of internal-combustion engines. During the operation of such a displacement machine working as a compressor, several approximately sickle-shaped working spaces are enclosed along the feed chamber between the spiral displacement body and the two cylinder walls of the feed chamber, as a result of a differing curvature of the spiral forms, and move through the feed chamber from a working-medium inlet towards a working-medium outlet, their volume being constantly reduced and the pressure of the working medium being increased correspondingly. The displacement bodies are formed by spiral strips which are held essentially vertically on the disk-shaped rotor and which have a relatively large axial length in comparison with their thickness. Similar conditions prevail on the side of the stationary housing, where spiral strip-like webs of relatively great length in the axial and peripheral directions in relation to the wall thickness likewise stand between the feed chambers.

Accurate rolling of a displacement body on the spiral principle as a result of a circular translational movement can be obtained by means of a double-crank mechanism, as is known, for example, from No. DE-A-3,107,231 and in which one crank drives and the second crank guides.

A serious problem arises when the displacement body having a large axial width is guided parallel to the housing inaccurately because of production deviations. No. DE-A-3,231,756 proposed to remedy this by making the guide element consist not of a crank, but of a crank rocker which is articulated on the housing at one end and on the displacement body at the other end and the length of which is greater than the length of the drive crank. Here too, the spiral strips are arranged so as to project axially on a disk having a hub for mounting the eccentric crank mechanism. The disk is radially flush with the strip, and the variable gap between the housing and the displacement body, caused as a result of movement, is then reduced to a minimum, without contact, by a special design of the guide element. At the same time, the longitudinal gaps are limited by overlapping radius-shaped surfaces of the housing, guide element and displacement body. An advantage of this type of guide and method of sealing is to be seen in the fact that the diameter of the disk-shaped rotor and consequently also of the housing can be reduced by the amount of double the crank length.

This advantage is not afforded in a design according to No. DE-A-3,107,231 which was mentioned in the introduction and which is used as a basis here. There, the rotor disk projects radially beyond the strip by an amount which, in any position of the displacement body, overlaps the housing recess then required. Sealing is then obtained by means of the axial gaps reduced to a minimum between the disk and the housing. However, this necessitates, on the one hand, a considerable increase in the size of the displacement body and housing and, on the other hand, a considerable increase in the number of sealing strips necessary.

SUMMARY OF THE INVENTION

The invention intends to remedy this. It is based on the object of designing a machine of the type mentioned in the introduction, in such a way that it is provided with the advantages of the second-mentioned version, that is to say with a small diameter and consequently a low weight and small volume.

According to the invention, this is achieved because the web with the outer cylinder wall of one feed chamber is continued, in the region of the inflow part of the second feed chamber offset approximately 180°, as a web with the inner cylinder wall of this second feed chamber, because the disk is radially flush with the strips and passes through the housing in the region of the inlets of the spirals, for which purpose the inner cylinder walls of the feed chambers in one housing half are lowered by the amount of the disk thickness, and the transition between the raised outer cylinder wall and the lowered inner cylinder wall takes the form of a circular step, and where, during the operation of the machine in periods when differing pressures prevail in radially adjacent feed spaces, this circular step cooperates with a clearance in the form of an arc of a circle in the disk for the purpose of forming a sealing line extending over the height of the step.

The basic sealing principle of No. DE-A-3,231,756, already discussed, is put into practice, here, in an expedient modification. It is true that a superficial examination of German Utility Model No. G85 11707.2 could prompt the thought that the design according to the invention was already put into effect there in view of the circular clearance in the disk between the spiral inflow and spiral outflow. Nevertheless, it can be seen that the sealing problem is not solved at all there, because the inflow region of the spiral is always in communication with the outflow region during the circular movement.

However, the idea on which the invention is based is that only those feed spaces in which the same pressure prevails communicate with one another during the circular movement. When there are different pressures in the spaces located next to one another, the sealing takes effect. This principle is only possible, however, with a nested arrangement of at least two spirals.

BRIEF DESCRIPTION OF THE DRAWING

An exemplary embodiment of the invention is illustrated diagrammatically in the drawing.

In the drawing.

Figure 2:
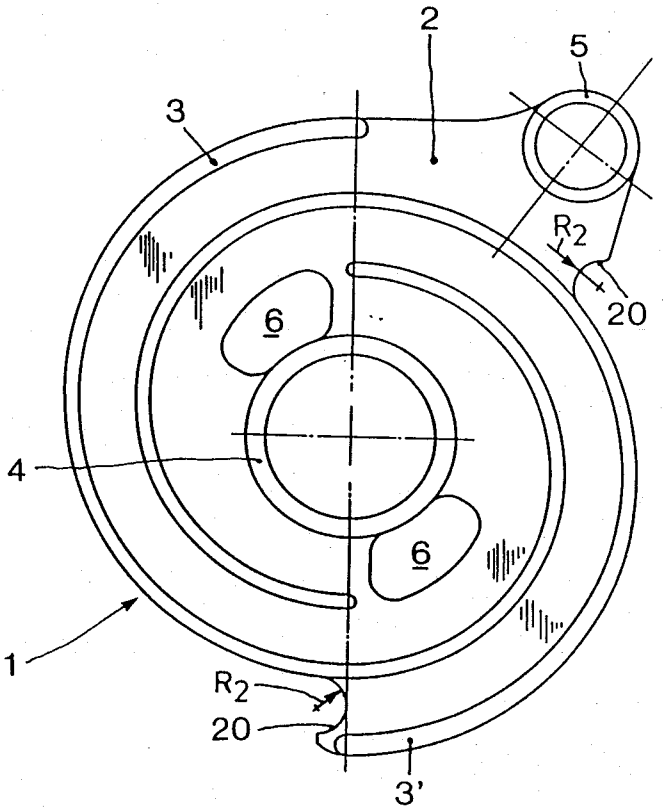
FIG. 2 shows a rotor.
Figure 1:
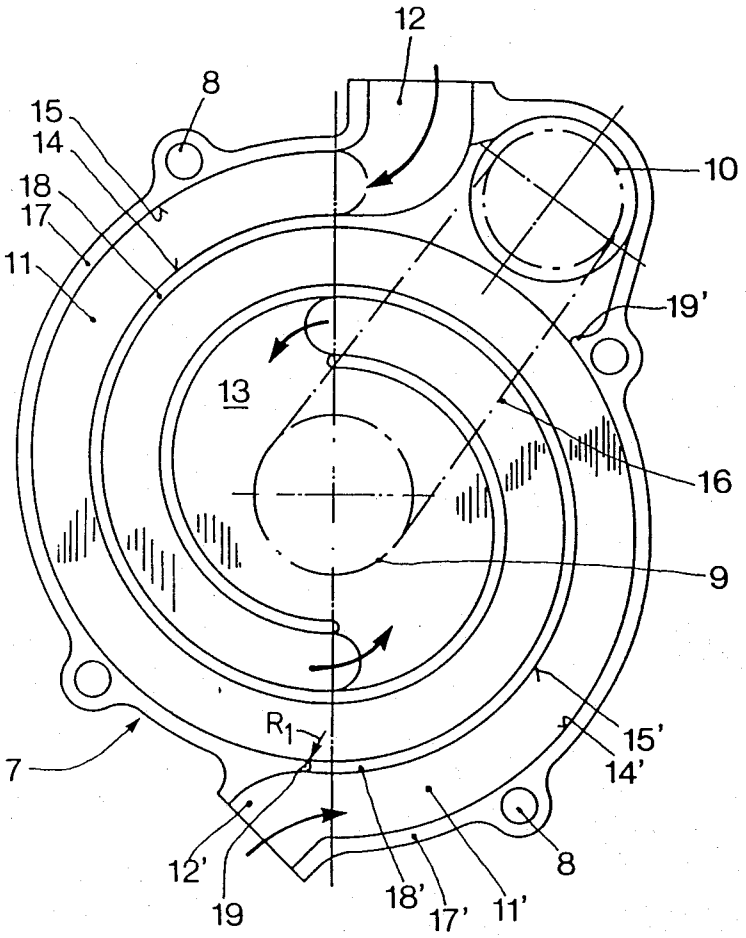
FIG. 1 shows a housing part with a wall design according to the invention.

For the sake of clarity, the machine is shown in the dismantled state in FIGS. 1 and 2. The drive is not shown because it is not essential to the invention; it is merely indicated in FIG. 1.

DESCRIPTION OF THE PREFERRED EMBODIMENTS

To explain the mode of operation of the compressor, which is likewise not the subject of the invention, attention is drawn to No. DE-C3-2,603,462, already mentioned. Only the machine construction and process cycle necessary for an understanding are described briefly below.

The rotor of the machine is designated as a whole by 1 in FIG. 2. On each of the two sides of the disk 2 are arranged two spiral displacement bodies offset 180° relative to one another. These are strips 3, 3' which are held vertically on the disk 2. In the example illustrated, the spirals themselves are formed from several arcs of a circle which adjoin one another. Because of the high ratio mentioned in the introduction between the axial length and the wall thickness, that end of each of the strips 3, 3' located on the inflow side is reinforced. 4 denotes the hub, by means of which the disk 2 is drawn onto a bearing (not shown). The bearing itself rests on an eccentric disk which is itself part of the drive shaft. 5 designates a lug arranged radially outside the strips 3, 3' and intended for receiving a guide bearing drawn onto an eccentric pin. The latter is itself part of a guide shaft. The eccentricity e of the eccentric disk on the drive shaft corresponds to that of the eccentric pin on the guide shaft. Perforations 6 are made in the disk 2 at the spiral outflow, so that the medium can flow from one side of the disk to the other, for example to be drawn off in a central outlet arranged on one side only.

FIG. 1 shows the lower housing half 7 of the machine housing composed of two halves and connected together by means of fastening lugs 8 for receiving screw fittings. 9 represents the receptacle for the drive shaft, and 10 denotes the receptacle for the guide shaft. 11 and 11' respectively designate the two feed spaces which are offset 180° relative to one another and which are made in the two housing halves in the manner of a spiral slot. They each extend from an inlet 12, 12' arranged in the housing on the outer periphery of the spiral to an outlet 13 provided in the housing interior and common to the two feed spaces. These have essentially parallel cylinder walls 14, 14' and 15, 15' which are arranged at a uniform distance from one another and which, in the present case, like the displacement body of the disk 2, extend over a spiral of approximately 360°. Between these cylinder walls engage the displacement bodies 3, 3', the curvature of which is calculated so that the strips virtually touch the inner and outer cylinder walls of the housing at several, for example, at two points in each case.

It can be seen from FIG. 1 that, in the region of the inlet 12', the web 17 with the outer cylinder wall 14 is continued in the web 18' with the inner cylinder wall 15'. This measure is also taken in the region of the inlet 12, although the geometry is shifted somewhat as a result of the guide eccentric. The transition from the web 17' to the web 18 takes place offset here, approximately by the amount of the diameter of the receptacle 10.

The two eccentric arrangements (4, 9 and 5, 10) arranged at a distance from one another ensure that the rotor 1 is driven and guided respectively. To ensure a definite guidance of the rotor in the dead-center positions, the two eccentric arrangements are synchronized exactly in angular terms by means of a toothed-belt drive 16 which is indicated. This double eccentric drive ensures that all points on the rotor disk and consequently also all points on the two strips 3 and 3' execute a circular shifting movement.

Because the strips 3, 3' approach the inner and outer cylinder walls of the associated feed chambers alternately several times, this produces, on both sides of the strips, sickle-shaped working spaces which enclose the working medium and which are shifted through the feed chambers towards the outlet during the drive of the rotor disk. The volumes of these working spaces are thereby reduced and the pressure of the working medium is increased correspondingly.

FIG. 1 shows that, with the exception of the radially projecting lug 5, the disk 2 is radially flush with the strips 3, 3'. This means that the disk must pass through at least one housing half in the radial direction in the region of the inlets 12, 12'. In the present case, this takes place in the lower housing half 7. For this purpose, the inner webs 18, 18' of the latter are lowered relative to the outer webs 17, 17' by the amount of the disk thickness. The advantage of this measure is that sealing strips sealing the feed spaces 11, 11' off from one another up to the outlet via the disk 2 have to be arranged in the lower housing half on the inner webs 18, 18' only.

If the transition from the web 17 to the web 18' were sharp-edged and occurred radially, and if the disk 2 were also consequently to terminate radially at the corresponding inflow parts, there would be a leak between the feed chambers 11 and 11'.

Figure 3:
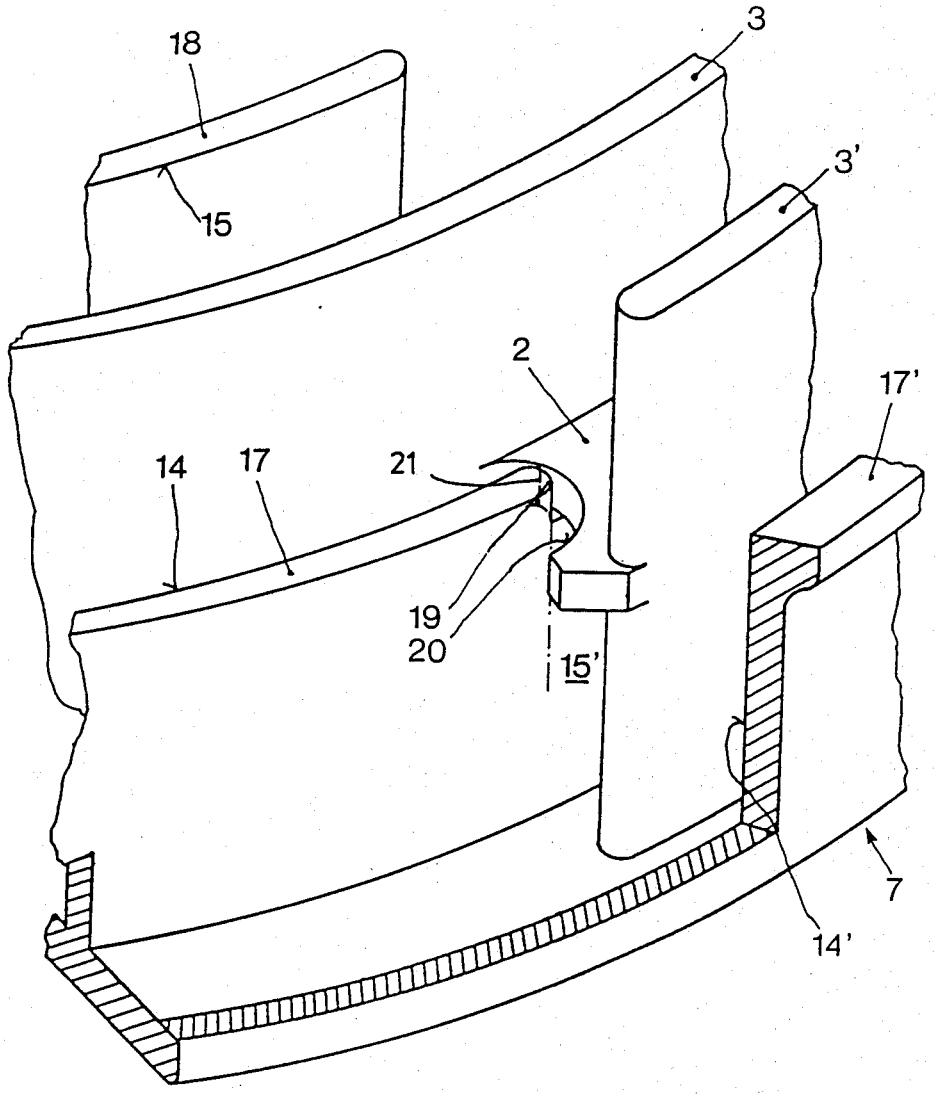
FIG. 3 shows a perspective part representation of a spiral inflow.

As can be seen from FIG. 1 and especially from FIG. 3, this transition now takes the form of a circular step 19, 19' of radius R1. The opposite surface on the disk 2 is provided with a clearance 20, 20' correspondingly in the form of an arc of a circle, the radius R2 of this clearance corresponding to the eccentricity e+the radius R1. FIGS. 4 to 7 show how these steps 19, 19' cooperate with the clearances 20, 20' in the form of an arc of a circle to form a sealing line 21 during the operation of the machine.

Figures 4, 5, 6, 7:
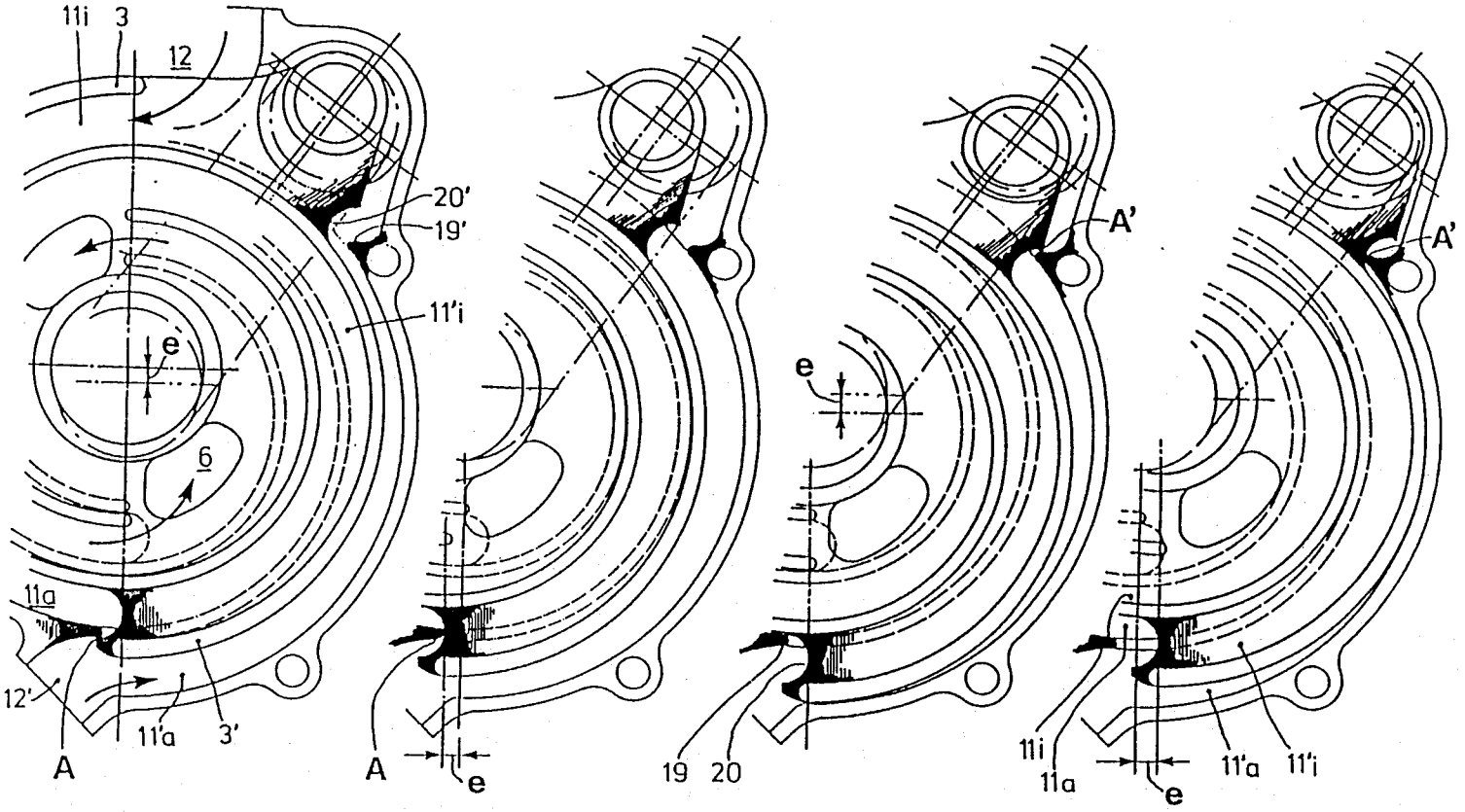
FIGS. 4 to 7 show part views of the rotor according to FIG. 2 located in the housing part according to FIG. 1, in the angular positions 0°, 90°, 180° and 270°.

In FIG. 4, in the angular position 0°, suction has just ended in the outer feed space 11a. The strip 3 rests (not shown) against the outer cylinder wall 14 both at the inlet 12 and at the outlet 13. On the opposite side, the suction process in the inner feed space 11'i has ended, that is to say the strip 3' rests against the inner cylinder wall 15' on the inflow side and on the outflow side. Since, during further rotation of the rotor, the feed process or the compression process, depending on the spiral configuration, now begins in the sickle-shaped closed working spaces, sealing at the point A is necessary so that the conveyed medium cannot escape into the inlet 12'. This is not necessary on the opposite side, because both the inner feed space 11i and the outer feed space 11'a are open towards their respective inlets 12 and 12'.

In the angular position 90° in FIG. 5, it can be seen how the clearance 20 rolls around the circular step 19 at the point A and thereby maintains the sealing effect.

At the angular position 180° according to FIG. 6, the suction process in the other feed space 11'a has ended. Sealing must therefore be ensured at the point A' so that the working medium cannot escape into the inlet 12 via the lowered web parts in the lug region.

The angular position of 270° shows that sealing continues to be maintained at A' and that there is no need for sealing in the inlet 12', since there both the inner and the outer feed spaces open towards their inlets and pressure equality prevails there.

What is claimed as new and desired to be secured by letters patent of the United States is:

1. A displacement machine for compressible media, comprising:

a stationary housing comprised of two housing halves, each of said housing halves having web means for defining two spiral feed spaces, each of said feed spaces having an inlet and defining a spiral slot having parallel cylinder walls arranged at a uniform distance from one another, said feed spaces being offset such that said inlets of said two feed spaces are offset by substantially 180°, wherein for each said housing halves, two outer portions of said web means form a radially outer wall of said housing, said outer portions of said web means forming a radially outer wall having an axial height greater than that of a remainder of said web means, said outer portions of said web means each corresponding to one of said feed portions and merging with said remainder at circular steps positioned adjacent said inlet of the other one of said feed portions;

a disc shaped rotor having a plurality of spiral strips formed thereon, said rotor being positioned relative to said housing halves such that each of said spiral strips fits into one of said feed spaces to form a displacement body capable of displacing a fluid from a respective one of said inlets when said rotor is eccentrically driven, wherein portions of said spiral strips define the radially outer periphery of said rotor and;

first and second guide eccentric means for eccentrically driving said rotor, wherein said first and second guide eccentric means oscillate said rotor at a position wherein a radially outer end of each of said spiral strip is adjacent one of said inlets of each of said housing halves, and wherein an edge of said rotor disc at each said outer end of said spiral strips forms a concave circular arc in sealing engagement with said circular steps during 180° of the oscillation of said rotor, whereby sealing cooperation of said circular arcs and said circular steps prevents leakage at said inlets between ones of said feed spaces having different pressures therein.

* * * * *